United States Patent [19]

Penn et al.

[11] 4,295,258

[45] Oct. 20, 1981

[54] PIN PULLER AND INSERTER

[75] Inventors: Eric J. Penn, San Jose; Derylle L. Teegarden, Sunnyvale, both of Calif.

[73] Assignee: National Semiconductor Corporation, Santa Clara, Calif.

[21] Appl. No.: 123,195

[22] Filed: Feb. 21, 1980

[51] Int. Cl.[3] ..... B25B 27/00

[52] U.S. Cl. ..... 29/283; 29/762

[58] Field of Search ..... 29/283, 762, 764, 766–770, 29/270, 267, 253; 145/46; 227/63; 269/329, 902, 909; 254/18, 21, 28

[56] References Cited

U.S. PATENT DOCUMENTS

| | | | |
|---|---|---|---|
| 590,760 | 9/1897 | Heath | 145/46 |
| 4,207,665 | 6/1980 | Kurek | 29/270 |
| 4.209,897 | 7/1980 | Davies | 29/768 |

FOREIGN PATENT DOCUMENTS

| | | | |
|---|---|---|---|
| 824457 | 12/1951 | Fed. Rep. of Germany | 254/18 |

*Primary Examiner*—Robert C. Watson
*Attorney, Agent, or Firm*—Brown & Martin

[57] ABSTRACT

A pin pulling and inserting block has a channel therein in the shape of a rectangular parallelepiped which opens on one end of the block and is large enough to admit the head of a retaining pin on an integrated circuit package shipping rail. There is a tapered ramp within the channel which progressively narrows the depth of the channel from a dimension which is larger than the depth of the pinhead to a dimension that will snugly hold the pinhead. A slot extends through the block from the channel opening and opens into the channel. The slot is wide enough to admit the shank of a pin whose head is admitted into the channel. There is a rounded surface on the end of the block opposite the channel opening which acts as a fulcrum for prying the pin out of the shipping rail. The pin remains snugly held in the channel after it is removed from the rail and can be easily inserted back into the rail by simply pressing the rail against the exposed end of the pin.

5 Claims, 6 Drawing Figures

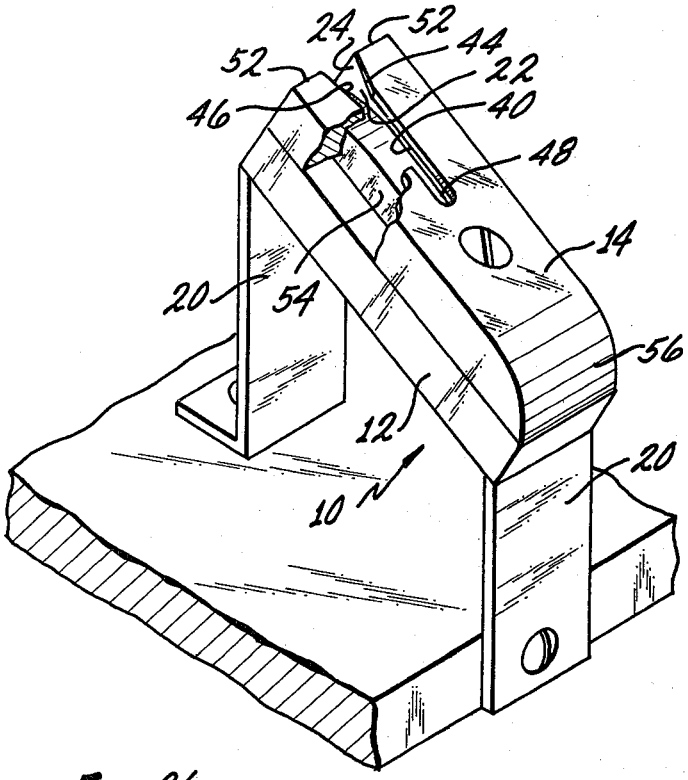
Fig. 1
Fig. 4
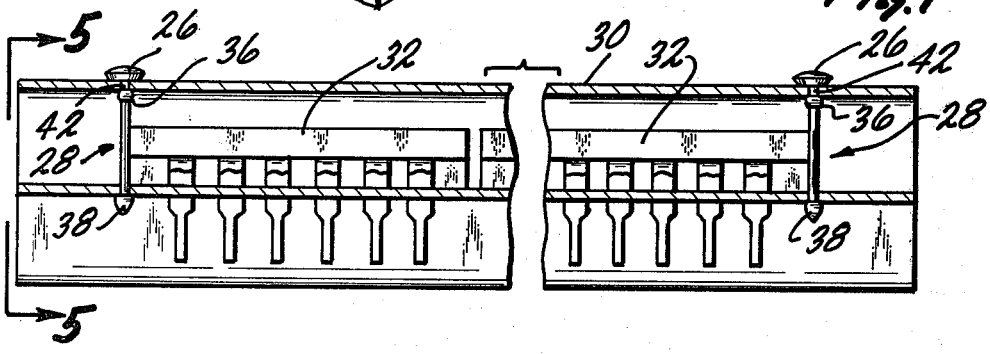
Fig. 5
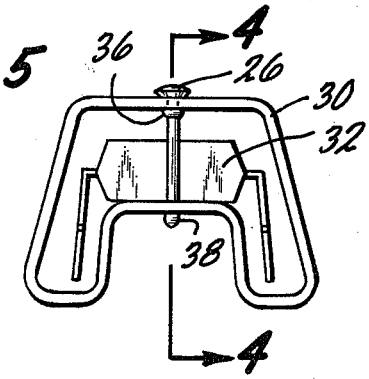
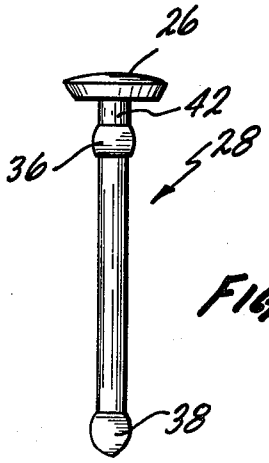
Fig. 6

PIN PULLER AND INSERTER

BACKGROUND OF THE INVENTION

This invention relates to a pin puller and inserter which is used to pull the retaining pins from and insert retaining pins into shipping rails for integrated circuit dual inline packages (DIPs). Shipping rails are plastic packages which are shaped like a hollow elongated rail and contain a plurality of DIPs lined up end on end and slideable within the rail. The shipping rails are open on both ends and the DIPs are retained in the rail by plastic retainer pins that pass through two transverse openings in the ends of the rail. The retainer pins have enlarged tips and enlarged shoulders under their heads to snap fit into the openings so that they do not fall out during handling of the rails. To remove the DIPs from the rail, one of the retaining pins is pulled out of the rail and the rail is tilted to allow the DIPs to slide out of the open end one at a time.

In the past, the pins have been pulled out of the rails by a hand held claw type puller. The rail was held in one hand and the claw puller was held in the other while the pin was pried out of the rail with the claw puller. Poor alignment of the claw puller and the rail during the pin removal frequently caused burring of the holes in the rail, which then impeded the flow of DIPs into or out of the rail. The pulled pin was laid aside and later reinserted using the thumb pressure to snap it in place.

SUMMARY OF THE INVENTION

This invention uses a stationary puller which enables the pin to be pulled from the rail using only one hand. The pin stays in the puller and is tightly held in place so it can be reinserted by simply pressing the rail against the tip of the pin. This also can be done with one hand. The puller consists of a block with a parallel piped shaped channel therein which opens on one end of the block and has a slot which extends from the open end of the channel along the channel and opens into the channel. The channel and the slot are dimensioned to admit the head and shank of a pin respectively. A tapered ramp in the channel progressively narrows the depth of the channel from a dimension which is larger than the depth of the pinhead to a dimension that will snugly hold the pinhead in the puller.

BRIEF DESCRIPTION OF THE DRAWINGS

FIG. 1 is a perspective view of the preferred embodiment of the invention partially cut away to reveal inner details.

FIG. 4 is a longitudinal sectional view of a shipping rail containing DIPs.

FIG. 5 is an end view taken on the line 5—5 of FIG. 4.

FIG. 6 is an enlarged view of one of the pins that go in the shipping rails.

DESCRIPTION OF THE PREFERRED EMBODIMENT

Figure 2:
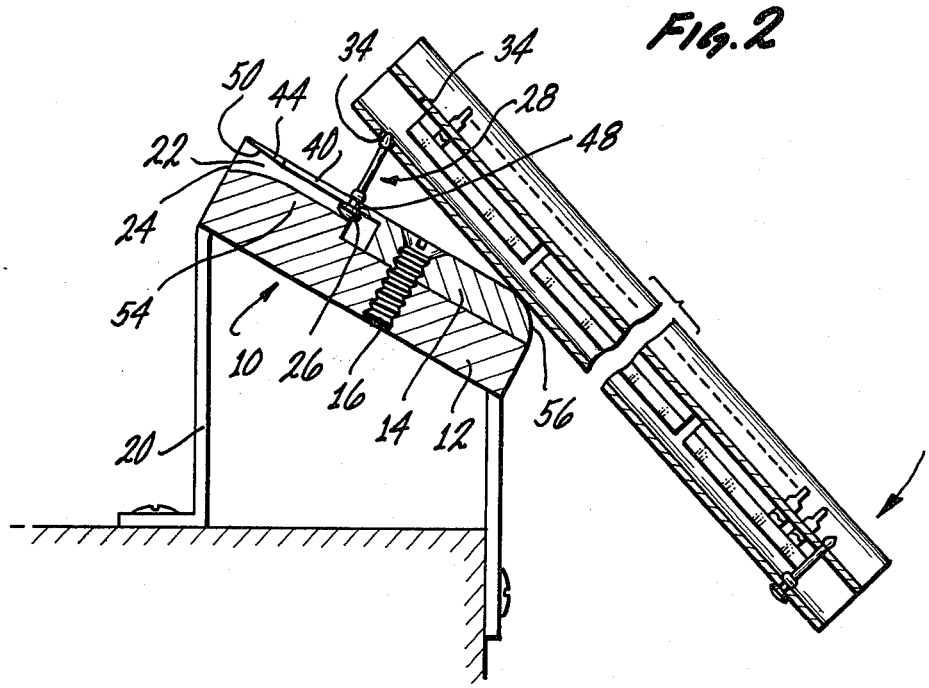
FIG. 2 is a longitudinal sectional drawing showing the pin being pulled from a shipping rail.
Figure 3:
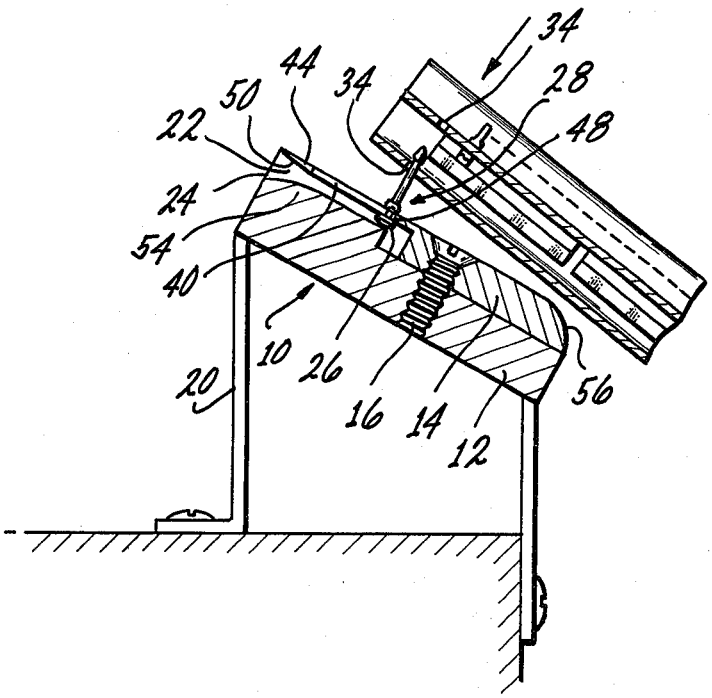
FIG. 3 is a longitudinal sectional view similar to FIG. 2 showing a pin being inserted into a shipping rail.

Referring to FIGS. 1, 2, and 3, the preferred embodiment of the invention includes a block 10 which is made of a lower portion 12 and an upper portion 14 which are joined together by bolt 16. Block 10 is mounted on the edge of table 18 by brackets 20 which are welded to block 10. Upper portion 14 has a channel 22 formed therein which opens on end 24 of block 10. When upper portion 14 and lower portion 12 are assembled, as shown in FIGS. 1, 2, and 3, channel 22 is in the general shape of a rectangular parallel piped channel 22 is dimensioned to admit the head 26 of a retaining pin 28 (FIG. 6) when it is inserted into a DIP shipping rail 30 as shown in FIGS. 4 and 5. Shipping rail 30 contains a plurality of DIPs 32 which are locked within rail 30 by a retaining pin 28 at both ends of rail 30. Pin 28 fits through openings 34 (FIGS. 2 and 3) and has an enlarged shoulder 36 and an enlarged tip 38 (FIG. 6) for adapting pin 28 to snap fit into openings 34.

A slot 40 (FIG. 1) is formed in the top of the upper portion 14 of block 10 and opens on open end 24 channel 22 and also opens into the upper side of channel 22. Slot 40 is dimensioned to admit the shank 42 (FIG. 6) of a pin 28 whose head 26 is admitted within channel 22. Slot 40 has outwardly inclined open end edges 44 and 46 (FIG. 1) to expedite insertion of shank 42 and is rounded at its closed end 48. The upper portion of channel 22 is inclined upwardly at 50 (FIGS. 2 and 3) to make a sharp edge 52 (FIG. 1) which can be wedged under pinhead 26 and can move it into channel 22 and slot 40.

A ramp 54 which is tapered to progressively narrow the depth of channel 22 is formed on lower portion 12 of block 10 and rests within channel 22. Ramp 54 progressively narrows the depth of channel 22 from a dimension which is larger than the depth of pinhead 26 to a dimension that will snuggly hold pinhead 26 in place as shown in FIGS. 2 and 3. This is important because it allows pins to be inserted into rails 30 as well as to be pulled therefrom as explained hereafter.

Block 10 has a rounded portion 56 (FIGS. 1, 2, and 3) on the end thereof opposite open end 24 to serve as a fulcrum for rail 30 when pin 28 is pulled as shown in FIG. 2. To pull a pin with the pin puller of this invention, the rail 30 is grasped with one hand and turned so that the head of the pin 26 is opposite the sharp edge 52 of block 10, and the rail is then pulled along the top of block 10 so that the head of the pin wedges under the inclined surface 50 and slides into the channel 22. The rail is then pulled to move the pinhead down to the bottom of channel 22 as shown in FIG. 2. When the pin reaches the bottom of channel 22, the lower end of the rail 30 is grasped and rocked around the curved surface 56 as indicated by the arrow in FIG. 2 to pull the pin out of the rail 30. The pin 28 stays in the block 10 after it is pulled out, and when the rail 30 is ready to be resealed, the resealing is down by taking the rail 30 in one hand, placing it with the tip of pin 28 opposite openings 34, and simply pushing it so that the openings 34 ride up over the enlarged portions of the pin 28 as shown in FIG. 3. One important advantage of this invention is that it allows pins to be pulled and inserted through the use of one hand only rather than requiring two hands as the manual devices that have been used heretofore require.

We claim:

1. A pin puller and inserter for pulling pins from an integrated circuit package shipping rail and inserting pins thereinto, comprising:

a elongated body member having a top and a bottom;

an elongated channel formed in said body member said channel having an outwardly flared opening at one end of said body member and being dimensioned to admit the head of a pin from an integrated circuit package shipping rail through said opening;

a tapered ramp in said channel which progressively narrows the depth of the channel from a dimension which is larger than the depth of the head of a pin to a dimension that will snugly hold the pinhead in place;

a slot in said body member extending from said channel opening along said channel and communicating into said channel, said slot being dimensioned to admit the shank of said pin when the head thereof is admitted into said channel;

a rounded fulcrum surface on said body member on the end thereof opposing said channel opening, said rounded surface serving as a fulcrum for engagement by a package, for pulling a pin whose head is in said channel; and mounting means on the bottom of said body member for mounting said body member in a fixed position at a convenient height and angle for use in removing pins from a package.

2. The pin puller and inserter defined in claim 1 wherein the surface where said channel opening and said slot are adjacent to each other is tapered to form a sharp edge perpendicular to said slot to expedite inserting the pinhead into said channel.

3. The pin puller and inserter defined in claim 1 or 2, wherein said body member is made of an upper portion and a lower portion, said upper portion being detachably secured to said lower portion and said ramp being formed on said lower portion and said channel being formed in said upper portion.

4. The pin puller and inserter defined in claim 3 wherein said rounded fulcrum surface is on the upper portion of said body member.

5. The pin puller of claim 3 wherein said mounting means is on said lower portion and is adapted to mount said body member with said channel opening, extending at an angle upward from the horizontal, and said fulcrum is positioned lower than said opening.

* * * * *